US005562072A

United States Patent [19]

Stoody, Jr.

[11] Patent Number: 5,562,072

[45] Date of Patent: Oct. 8, 1996

[54] VALVE LASH ADJUSTMENT FOR OVERHEAD CAMSHAFT TYPE ENGINE

[75] Inventor: Richard R. Stoody, Jr., Rochester Hills, Mich.

[73] Assignee: Chrysler Corporation, Auburn Hills, Mich.

[21] Appl. No.: 523,100

[22] Filed: Sep. 1, 1995

Related U.S. Application Data

[63] Continuation-in-part of Ser. No. 300,773, Sep. 6, 1994, abandoned.

[51] Int. Cl.[6] ..... F01L 1/04

[52] U.S. Cl. ..... 123/90.27; 123/90.31

[58] Field of Search ..... 123/90.15, 90.17, 123/90.19, 90.27, 90.31, 90.6

[56] References Cited

U.S. PATENT DOCUMENTS

| | | | |
|---|---|---|---|
| 3,538,895 | 11/1970 | Jensen | 123/90.27 |
| 4,205,634 | 6/1980 | Tourtelot, Jr. | 123/90.15 |
| 4,438,737 | 3/1984 | Burandt | 123/90.17 |
| 4,541,372 | 9/1985 | Weiss | 123/90.17 |
| 4,552,112 | 11/1985 | Nagao et al. | 123/90.17 |

*Primary Examiner*—Weilun Lo
*Attorney, Agent, or Firm*—Kenneth H. MacLean

[57] ABSTRACT

For an overhead camshaft type internal combustion engine, a valve lash adjustment system and apparatus using a sliding wedge for adjusting a bearing support for a journal of the camshaft thus moving the camshaft itself relative to a valve.

4 Claims, 1 Drawing Sheet

VALVE LASH ADJUSTMENT FOR OVERHEAD CAMSHAFT TYPE ENGINE

RELATED APPLICATION

This is a continuation-in-part of application Ser. No. 08/300,773, filed Sep. 6, 1994, now abandoned.

BACKGROUND OF THE INVENTION

1. Field of the Invention

This invention concerns a selectively movable bearing support for a camshaft journal as utilized in an internal combustion engine's overhead camshaft type cylinder head. The support apparatus includes a member with a pair of spaced legs which extend upwardly from a top surface of a cylinder head. The legs extend along either side of a camshaft bearing assembly and guide vertical movements of the bearing assembly either towards or away from the top surface of the cylinder head. A selectively movable wedge is positioned between the bearing assembly and an end cap which extends across and is attached to the upper ends of the spaced legs. By adjusting the position of the wedge, the bearing assembly and thus the camshaft is moved towards or away from the cylinder head.

2. Description of Related Art

A pre-examination search of the subject apparatus has uncovered the following references.

U.S. Pat. Nos. 4,205,634; 4,438,737; and 4,414,931 disclose use of a wedge or a movable fulcrum device to vary the timing and lift of a valve train with an overhead cam type engine. None of these patents disclose the wedge lash adjuster for a movable bearing journal in an overhead camshaft type of engine.

U.S. Pat. No. 1,687,082 discloses a valve timing adjustment using a movable sleeve on a shaft. This patent does not disclose the wedge lash adjuster for a bearing journal in an overhead camshaft type of engine.

U.S. Pat. Nos. 4,570,581 and 4,723,517 disclose various valve train timing changing mechanisms unlike the subject wedge lash adjuster for a bearing journal in an overhead camshaft type of engine.

SUMMARY OF THE INVENTION

This invention is directed to a selective adjustment apparatus for an overhead camshaft to establish desired valve lash adjustment. A movable wedge shaped adjuster is selectively positioned to locate a camshaft bearing assembly and the camshaft journal relative to the cylinder head and the valves themselves. The adjustment also alters the degree of overlap between intake valve and exhaust valve timing events. This may be desirable for improving emission characteristics and for increased engine performance. The subject adjusting apparatus is both simple and reliable.

Other advantageous features will become more apparent from the following description.

DETAILED DESCRIPTION OF AN EMBODIMENT

Figure 1:
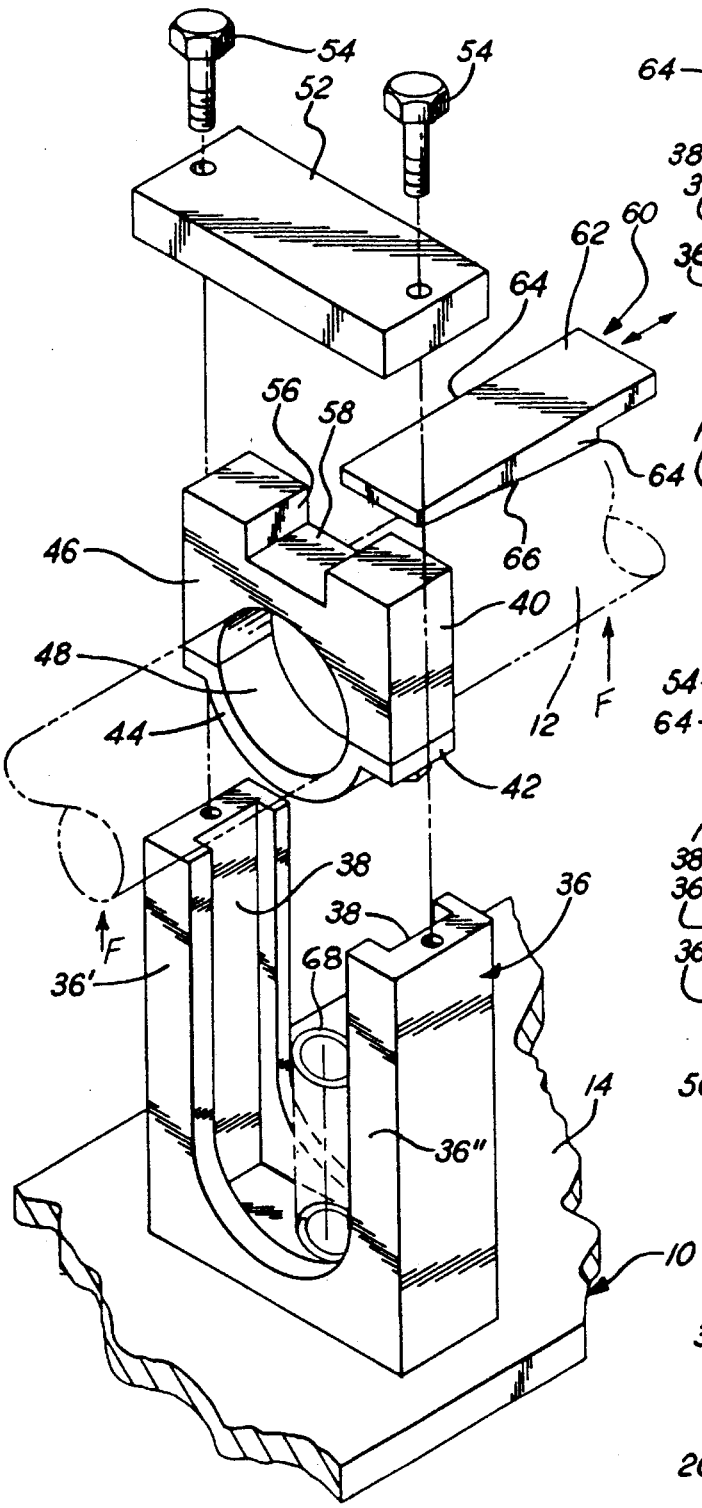
FIG. 1 is an exploded and perspective view of the adjustable camshaft bearing support apparatus.

A portion 10 of an overhead camshaft type of cylinder head for an internal combustion engine is illustrated in FIG. 1. The cylinder head shown in FIG. 1 has an associated single camshaft 12 but the subject adjusting apparatus can also be utilized with a dual overhead type of cylinder head. Only a portion of camshaft 12 is shown with an axis extending generally parallel to the upper surface 14 of the cylinder head 10.

Figure 4:
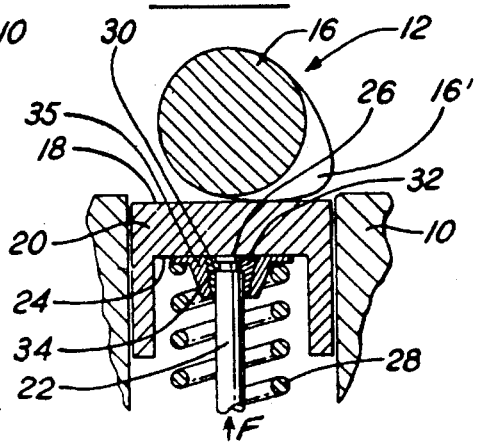
FIG. 4 is an elevational sectioned view taken along the camshaft and through a typical lobe portion thereof and showing engagement of the lobe with a tappet device of the valve.

As is known is the engine art, overhead type camshafts utilize lobe portions which periodically engage valve tappets as the camshaft is rotated. This engagement moves the valves from a normally closed operative position to a more opened operative position. Referring specifically to FIG. 4, the cylindrical body portion 16 of the camshaft 12 and an eccentric lobe portion 16' is illustrated. As camshaft 12 is rotated, the lobe portion 16' slides across surface 18 of a typical bucket type tappet member 20. This interaction generates a downward force on the tappet member 20 which is transferred to an associated valve 22.

Specifically, a lower surface 24 of the tappet member 20 engages the upper end 26 of the cylinder head's valve stem portion 22. Resultantly, the valve stem 22 is forced downward to cause the associated valve to move to a more opened position. The generally downward force generated by camshaft lobe 16' against surface 18 is opposed by a force F created by a coil type valve spring 28. This force F generated by the spring 28 is applied upwardly which tends to move camshaft 12 away from cylinder head surface 14 as shown in FIG. 4.

Valve spring 28 is restrained axially and is operatively attached to valve stem 22 by a pair of half-round retainers 30, 32 which project into a groove 34 formed in valve stem 22. Retainers 30, 32 axially secure a valve spring keeper (annulus) 35 to valve stem 22. When camshaft 12 and tappet 20 are removed away from the valve stem 22, such as during disassembly of the engine, the retainers 30, 32 maintain the valve spring keeper 35 to the upper end of valve stem 22. Resultantly, valve spring 28 is fixed to a closed valve operative position.

Figure 2:
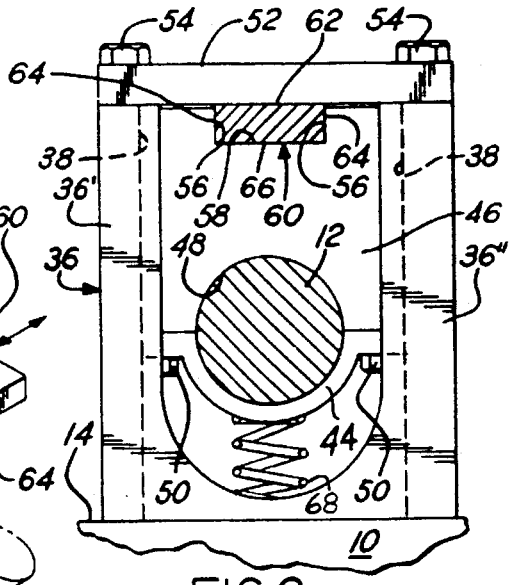
FIG. 2 is an elevational sectioned view of the bearing support apparatus and camshaft journal shown in FIG. 1 in a first operative position.
Figure 3:
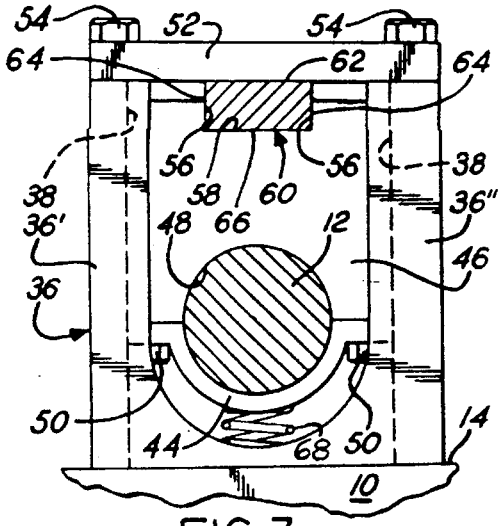
FIG. 3 is an elevational sectioned view of the bearing support apparatus and camshaft journal shown in FIG. 1 in a second operative position.

Referring again to FIG. 1, camshaft 12 is supported for rotation relative to the surface 14 of the cylinder head 10 by a plurality of support assemblies, only one of which is shown in FIG. 1. This support assembly includes an upstanding member 36 extending from cylinder head surface 14. Specifically, member 36 has two leg portions 36' and 36" each extending upwards in spaced parallelism. A channel 38 is formed in each leg portion, specifically in its inwardly facing side surface. The channels 38 receive edge portions 40, 42 of a camshaft bearing assembly which includes a semi-circular lower part 44 and a semi-circular upper part 46. Together, parts 44, 46 define circular bearing 48 adapted to encircle and support a journal formed on camshaft 12. As seen in FIGS. 2 and 3, parts 40 and 42 are secured together about the camshaft journal by fasteners 50.

The support assembly permits the attached parts 44, 46 which support the camshaft 12 to slide in channels 38 up and down or toward and away from cylinder head surface 14. The upwards movement is limited by an end piece or cap 52 which is secured to leg portions 36', 36" by fasteners 54.

The upper edge portion of part 46 has a channel 56 formed therein thus defining a bottom surface 58 aligned in an axial direction of camshaft 12. A wedge member 60 is positioned to extend over surface 58. Specifically, wedge 60 has an upper surface 62 and side surfaces 64 which guide movement of the wedge 60 through channel 56. Wedge 60 has a very slightly inclined bottom surface 66 which is adapted to slidingly engage surface 58 formed on part 46. As seen in FIGS. 2 and 3, an axial movement of the wedge 60 into the channel 56 from the position shown in FIG. 1 will cause the parts 44, 46 to move downward toward the cylinder head surface 14. This moves the whole camshaft downward towards tappet 20 and valve 22 shown in FIG. 4.

In FIG. 1, it can be seen that each camshaft support assembly (except the assembly located at the forward and rearward end of the cylinder head) is biased upwardly by a force F exerted upwardly on either side of the support assembly. These forces F are generated by the valve springs 28 shown in FIG. 4. In a single camshaft engine with four cylinders to a bank (a four or eight cylinder engine), there would be eight separate forces F applied to the camshaft and tending to move it and its support parts 44, 46 upward against the blocking action of wedge 60.

In FIGS. 1–3, a relatively light coil spring 68 is provided between the lower part 44 and the base of the assembly 36. Spring 68 constantly urges parts 44, 46 upward against the wedge 60 to eliminate any clearances therebetween.

A primary function of the above described apparatus is to establish a desirable small spacing between the circular portion of the camshaft lobe and the surface 18 of the tappet 20. This spacing is referred to as valve lash. Valve lash is greater at normal ambient temperatures such as 15 degrees F. than at higher temperatures. As a engine approaches its operating temperature where the coolant temperature is about 220 degrees F., the valve lash becomes very small. Thus, the purpose of adjusting valve assemblies at a specified valve lash is to accommodate thermal expansion of engine parts, particularly exhaust valves.

In FIG. 2, wedge 60 has positioned the camshaft (and its lobe) relatively higher or further from the surface 14 and valve stems 22 than as shown in FIG. 3. In FIG. 3, wedge 60 has been moved axially into channel 56 so as to move the camshaft and the lobes thereon downward towards surface 14 and valve stems 22.

While a preferred embodiment of the subject valve lash adjusting system and apparatus has been illustrated and described, other embodiments will now become apparent to those skilled in the art and thus the invention is not necessarily limited to what is illustrated and described but by the following claims.

What is claimed is:

1. In an overhead camshaft type cylinder head having an upper surface and supporting engine valves and a camshaft, a camshaft journal support assembly, comprising: a base member having a pair of spaced leg portions extending from the upper surface of the cylinder head and each terminating at an outer end; a camshaft bearing assembly encircling the camshaft and extending between said pair of leg portions; means of the leg portions and the bearing assembly guiding movements of said bearing assembly toward and away from the cylinder head upper surface; an end cap member attached to the outer ends of said legs; a movable wedge member positioned between said end cap member and said bearing assembly to establish the position of the support assembly and the camshaft relative to the upper surface of the cylinder head; said wedge member characterized with a variable thickness from one end to an opposite end so that movement of said wedge member past said end cap and said bearing assembly selectively adjusts the position of the camshaft relative to the engine valves.

2. For supporting a camshaft adjacent to an upper surface of an engine cylinder head having engine valves therein, an adjustable bearing support arrangement, comprising: a base member with a pair of spaced leg portions which extend away from the cylinder head upper surface; a camshaft bearing assembly encircling the camshaft and having opposite edge portions each slidingly engaging one of the pair of leg portions, respectively, for support; means of said leg portions and said edge portions of said bearing assembly guides movement of said bearing assembly in sliding relation relative to the leg portions as said bearing assembly is selectively moved towards and away from the cylinder head upper surface; an end cap member attached to said legs outwardly from the cylinder head's upper surface; a wedge member positioned between said end cap member and said bearing assembly to establish the position of the assembly relative to said upper surface and therefore the position of the camshaft relative to the engine valves; said wedge member varying in thickness from one end to an opposite end so that movement of said wedge relative to said cap and said bearing assembly adjusts the position of the camshaft relative to the cylinder head upper surface.

3. The adjustable bearing support arrangement set forth in claim 2 in which a channel is formed in each of said leg portions to receivingly engage an edge portion of said camshaft bearing assembly wherein the channel guides movement of said camshaft bearing assembly towards and away from said upper surface of said cylinder head.

4. The adjustable bearing support arrangement set forth in claim 2 in which a channel is formed in each leg portion adjacent an edge portions of said bearing assembly wherein the edge portions slidingly move within said channels as said bearing assembly is selectively moved towards and away from said upper surface of said cylinder head by insertion of said wedge member between said end cap member and bearing assembly.

* * * * *